US010753696B1

(12) United States Patent
Christopher et al.

(10) Patent No.: US 10,753,696 B1
(45) Date of Patent: Aug. 25, 2020

(54) BOLT CATCH ENGAGEMENT/MAGAZINE RELEASE SYSTEM

(71) Applicants: Louis C. Christopher, Oldsmar, FL (US); George K. Ameres, Lutz, FL (US)

(72) Inventors: Louis C. Christopher, Oldsmar, FL (US); George K. Ameres, Lutz, FL (US)

( * ) Notice: Subject to any disclaimer, the term of this patent is extended or adjusted under 35 U.S.C. 154(b) by 0 days.

(21) Appl. No.: 16/697,379

(22) Filed: Nov. 27, 2019

Related U.S. Application Data

(60) Provisional application No. 62/772,960, filed on Nov. 29, 2018.

(51) Int. Cl.

| | |
|---|---|
| ***F41A 17/42*** | (2006.01) |
| ***F41A 17/36*** | (2006.01) |
| ***F41A 3/42*** | (2006.01) |
| ***F41A 35/06*** | (2006.01) |
| ***F41A 9/59*** | (2006.01) |
| ***F41A 17/38*** | (2006.01) |

(52) U.S. Cl.
CPC ..... *F41A 17/36* (2013.01); *F41A 3/42* (2013.01); *F41A 9/59* (2013.01); *F41A 17/38* (2013.01); *F41A 17/42* (2013.01); *F41A 35/06* (2013.01)

(58) Field of Classification Search
CPC ..... F41A 17/42; F41A 17/38; F41A 17/36; F41A 17/35
See application file for complete search history.

(56) References Cited

U.S. PATENT DOCUMENTS

| | | | | |
|---|---|---|---|---|
| 2015/0323271 | A1* | 11/2015 | McGinty | F41A 3/72 42/17 |
| 2017/0160026 | A1* | 6/2017 | Walther | F41A 3/68 |
| 2018/0149438 | A1* | 5/2018 | Headrick | F41A 9/65 |
| 2020/0096267 | A1* | 3/2020 | Horst | F41A 3/42 |

* cited by examiner

*Primary Examiner* — J. Woodrow Eldred

(57) ABSTRACT

A firearm has a first side, a second side, a forward section with a barrel, and a rearward section with a stock. The firearm has a central section with an actuation button on the first side and a bolt catch and bolt catch linkage on the second side. A magazine and magazine release are between the actuation button and the bolt catch linkage. An actuation pin extends through the central section from the actuation button to both the bolt catch linkage and the magazine release. A coil spring urges the actuation button outwardly to an inoperative extended orientation. The actuation button is adapted to be depressed for both releasing the magazine and engaging the bolt catch.

6 Claims, 4 Drawing Sheets

FIG. 1
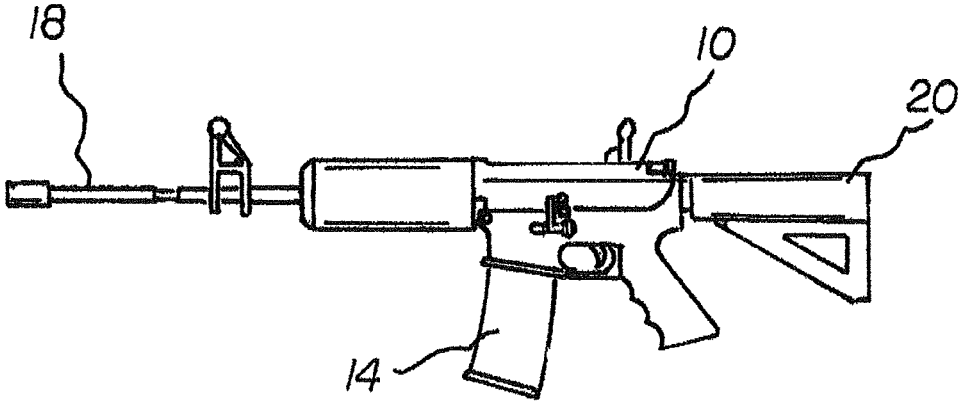
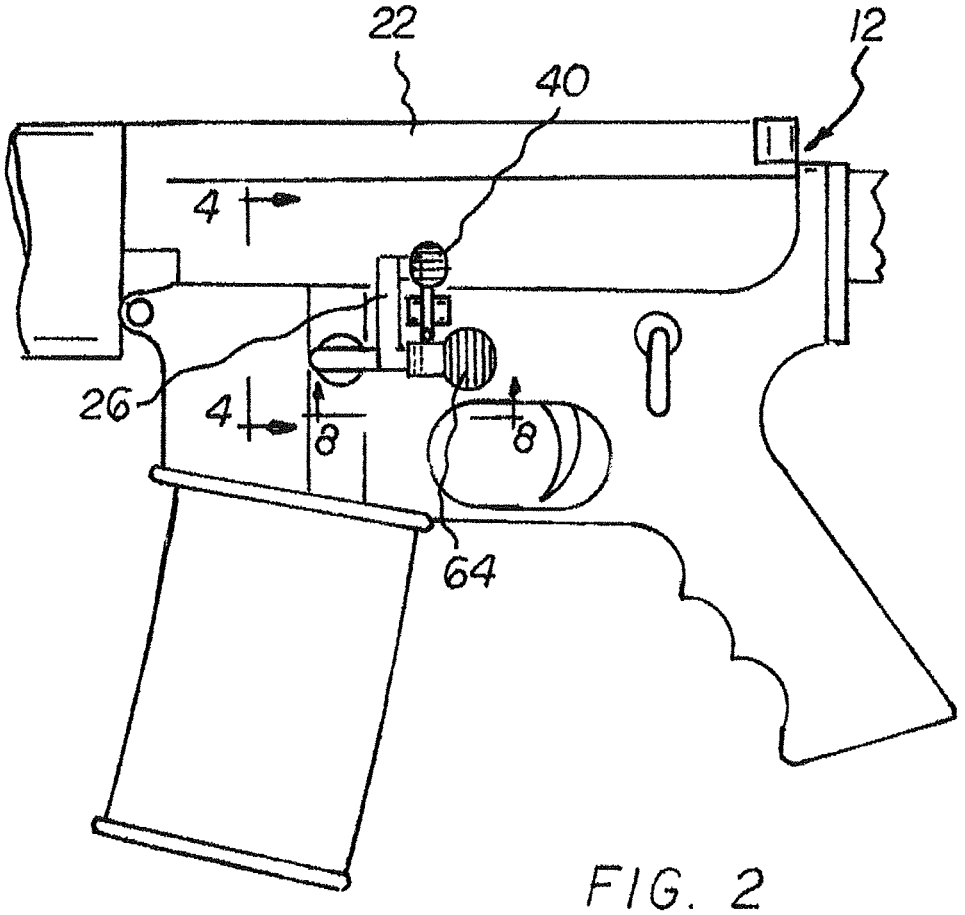
FIG. 2

FIG. 3
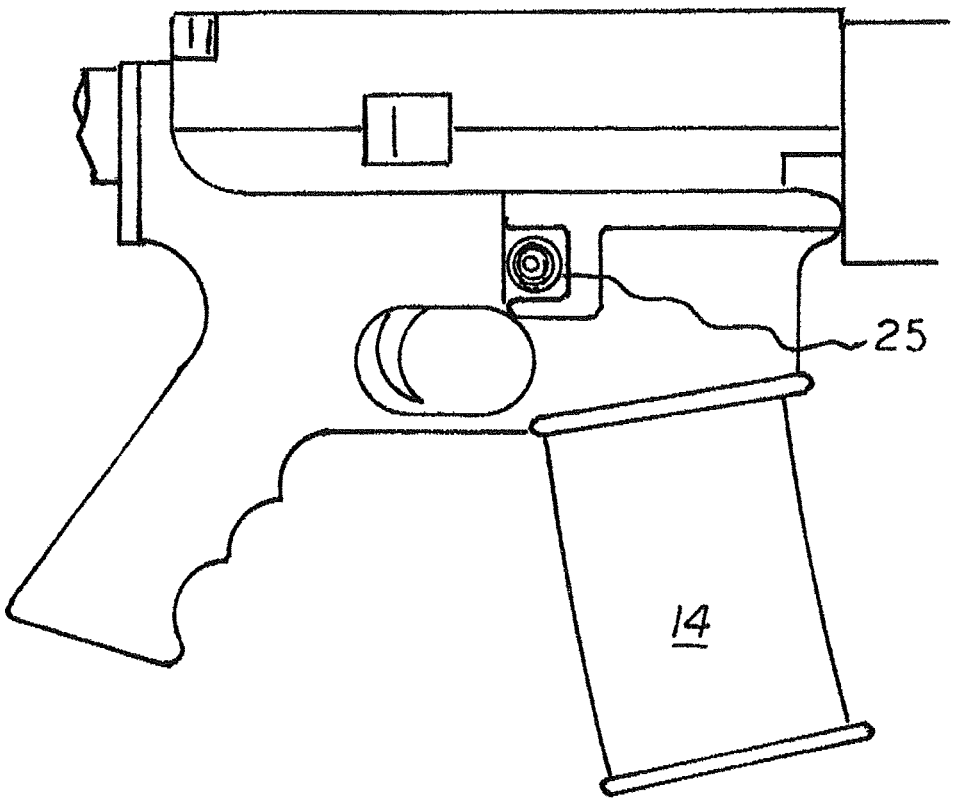
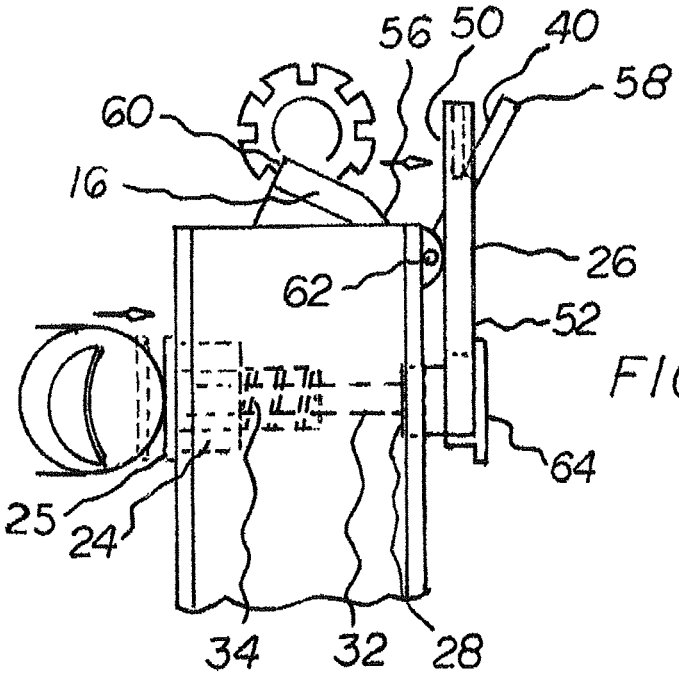
FIG. 4

BOLT CATCH ENGAGEMENT/MAGAZINE RELEASE SYSTEM

RELATED APPLICATION

The present invention is based upon Provisional Application No. 62/772,960 filed Nov. 29, 2018, the subject matter of which is incorporated herein and the priority of which is claimed.

BACKGROUND OF THE INVENTION

Field of the Invention

The present invention relates to a bolt catch engagement/magazine release system and more particularly pertains to releasing a magazine and engaging a bolt catch with a single movement in a safe and convenient manner.

Description of the Prior Art

The use of bolt catch engagement and magazine release systems of known designs and configurations is known in the prior art. More specifically, bolt catch engagement and magazine release systems of known designs and configurations previously devised and utilized for the purpose of releasing a magazine and engaging a bolt are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a bolt catch engagement/magazine release system that allows for the release a magazine and engaging a bolt catch with a single movement in a safe and convenient manner.

In this respect, the bolt catch engagement/magazine release system according to the present invention substantially departs from the conventional concepts and designs of the prior art, and in doing so provides an apparatus primarily developed for the purpose of releasing a magazine and engaging a bolt catch with a single movement in a safe and convenient manner.

Therefore, it can be appreciated that there exists a continuing need for a new and improved bolt catch engagement/magazine release system which can be used for releasing a magazine and engaging a bolt catch with a single movement in a safe and convenient manner. In this regard, the present invention substantially fulfills this need.

SUMMARY OF THE INVENTION

In view of the disadvantages inherent in the known types of bolt catch engagement and magazine release systems of known designs and configurations now present in the prior art, the present invention provides an improved bolt catch engagement/magazine release system. As such, the general purpose of the present invention, which will be described subsequently in greater detail, is to provide a new and improved bolt catch engagement/magazine release system and method which has all the advantages of the prior art and none of the disadvantages.

To attain this, the present invention essentially comprises a bolt catch engaging/magazine release system comprising a firearm and an actuation pin. First provided is the firearm which has a first side, a second side, a forward section with a barrel, a rearward section with a stock, a magazine, and a bolt catch. The firearm has a central section with an actuation button on the first side and a bolt catch linkage on the second side. A magazine release is between the actuation button and the bolt catch linkage. Next provided is the actuation pin. The actuation pin extends through the central section from the actuation button to both the bolt catch linkage and the magazine release. A coil spring urges the actuation button outwardly to an inoperative extended orientation. The actuation button is adapted to be depressed for both releasing the magazine and engaging the bolt catch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved bolt catch engagement/magazine release system which has all of the advantages of the prior art bolt catch engagement and magazine release systems of known designs and configurations of known designs and configurations and none of the disadvantages.

It is another object of the present invention to provide a new and improved bolt catch engagement/magazine release system which may be easily and efficiently manufactured and marketed.

It is further object of the present invention to provide a new and improved bolt catch engagement/magazine release system which is of durable and reliable constructions.

An even further object of the present invention is to provide a new and improved bolt catch engagement/magazine release system which is susceptible of a low cost of manufacture with regard to both materials and labor, and which accordingly is then susceptible of low prices of sale to the consuming public, thereby making such bolt catch engagement/magazine release system economically available to the buying public.

Lastly, it is another object of the present invention is to provide a bolt catch engagement/magazine release system which can be used for releasing a magazine and engaging a bolt catch in a single movement in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a left side elevational view of a rifle with a bolt catch engagement/magazine release system constructed in accordance with the principles of the present invention.

FIG. 2 is an enlarged left side elevational view of the receiver with its bolt catch shown in FIG. 1.

FIG. 3 is an enlarged right side elevational view of the receiver with its magazine release shown in FIG. 1.

FIG. 4 is a cross sectional view taken along line 4-4 of FIG. 2.

The same reference numerals refer to the same parts throughout the various Figures.

DESCRIPTION OF THE PREFERRED EMBODIMENT

Figure 5:
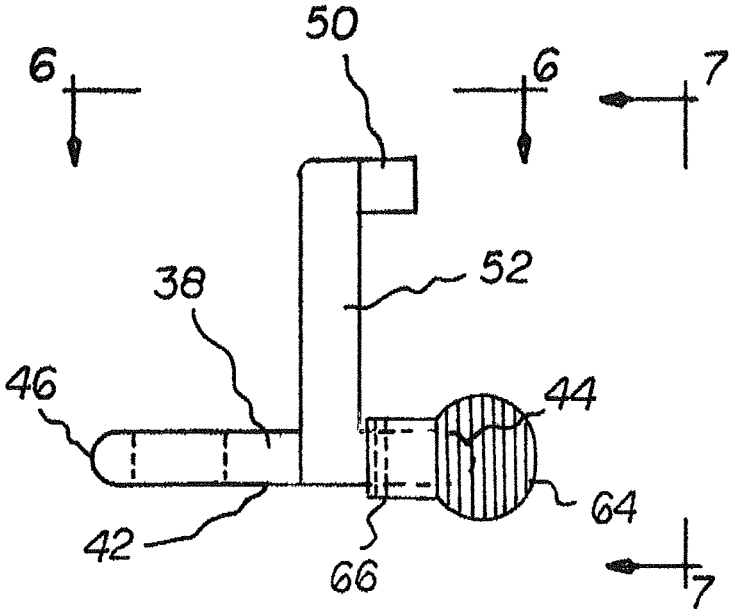
FIG. 5 is a side elevational view of the shiftable linkage for the bolt catch.
Figure 6:
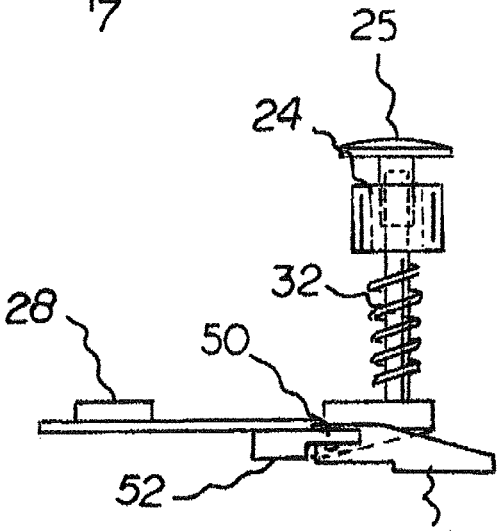
FIG. 6 is a plan view of the shiftable linkage for the bolt catch taken along line 6-6 of FIG. 5.
Figure 7:
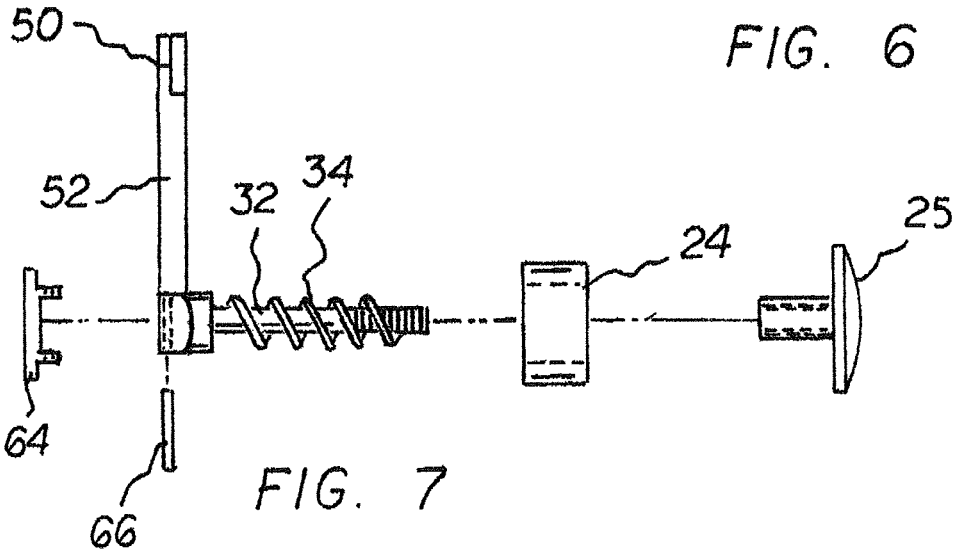
FIG. 7 is an exploded plan view of the shiftable linkage for the bolt catch taken along line 7-7 of FIG. 5.
Figure 8:
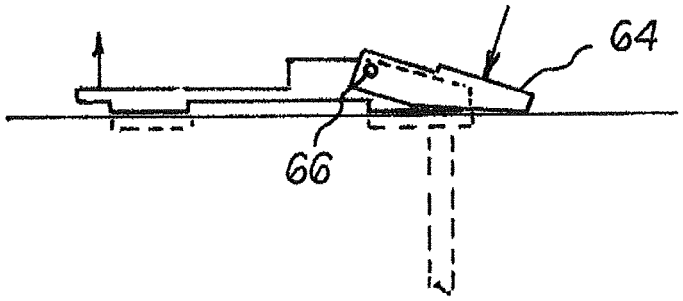
FIG. 8 is an enlarged showing of the secondary button and pivot pin illustrated in FIG. 6.

With reference now to the drawings, and in particular to FIG. 1 thereof, the preferred embodiment of the new and improved bolt catch engagement/magazine release system embodying the principles and concepts of the present invention and generally designated by the reference numeral 10 will be described.

The present invention, the bolt catch engagement/magazine release system 10 is comprised of a plurality of components. Such components in their broadest context include a firearm and an actuation pin. Such components are individually configured and correlated with respect to each other so as to attain the desired objective.

A rifle 10 with a bolt catch engagement/magazine releasing system 12 is provided. Both releasing a magazine 14 and engaging a bolt catch 16 are done with a single movement. The single movement with the releasing and the engagement is done in a safe, convenient, and convenient manner.

First provided in the preferred embodiment is the rifle 10. The rifle has a forward section 18 with a barrel and a rearward section 20 with a stock. The rifle has a central section 22 with an actuation button 25 on the right side and bolt catch linkage 26 on the left side. A magazine release 28 is between the actuation button and the bolt catch linkage.

Next provided is an actuation pin 32 extending through the central section from the actuation button to both the bolt catch linkage and the magazine release. A spacer 24 and a coil spring 34 urges the actuation button outwardly to an inoperative extended orientation. The actuation button is adapted to be depressed for both releasing the magazine and engaging the bolt catch.

A bolt catch and bolt catch linkage 26 are provided next. The bolt catch linkage has a shiftable component 38 and a pivotable component 40. The shiftable component has a lower element 42 extending horizontally with a forward end 44 coupled to the shiftable pin. The lower element also has a rearward end 46. The lower element has a central region 38, the shiftable component, between the forward end and the rearward end. The shiftable component also has an upper element 50 extending horizontally. The shiftable component also has a middle element 52 extending vertically between the upper element and the central region of the lower element. The pivotable component 40 has an L-shaped link 56. The L-shaped link has an input leg 58 and an output leg 60 with a pivot pin 62 there between. The input leg in response to pressing the actuation button is adapted to be contacted by the upper element and move downwardly to thereby pivot the output leg downwardly away from the bolt catch to engage the bolt catch.

Lastly, a secondary button 64 is provided. The secondary button is positioned on the left side of the firearm, the side opposite from the actuation button 24. The actuation button is more readily accessible to a right-handed shooters. The secondary button is more accessible to a left-handed shooter. The system may thus be considered an ambidextrous system. A pivote pin 66 operatively couples the secondary button to the bottom of the middle element 52. In this manner, pressing the secondary button pulls the actuation pin 32 as if the actuation button 24 were depressed.

Figure 9:
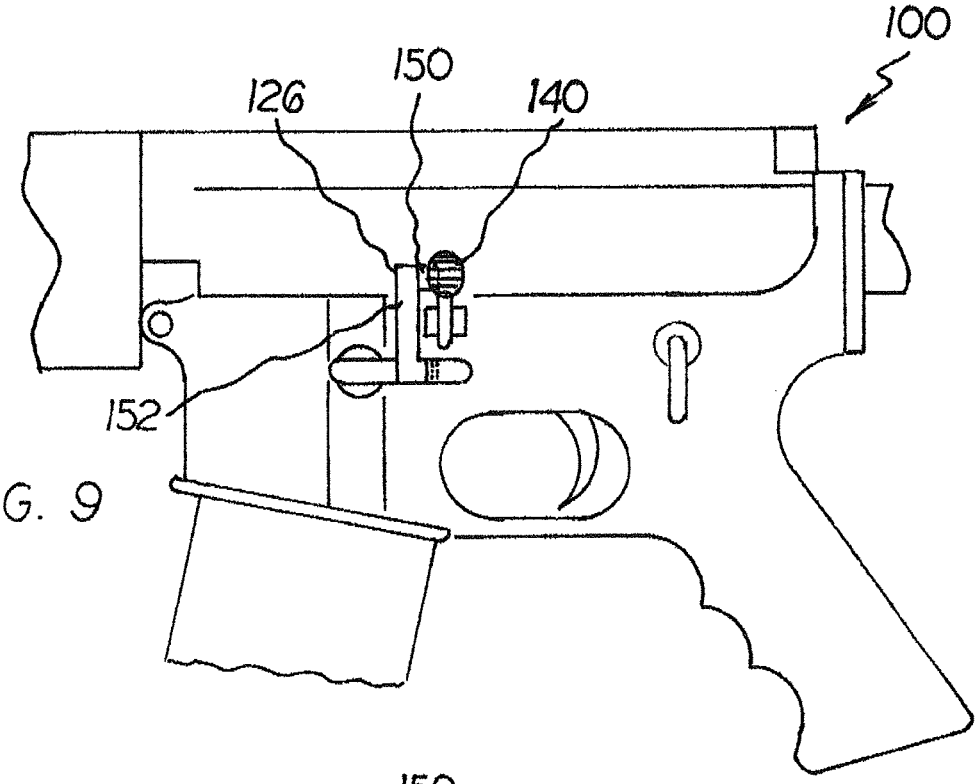
FIG. 9 is an enlarged left side elevational view of the receiver similar to FIG. 2 but illustrating an alternate embodiment of the invention with the secondary button removed.
Figure 10:
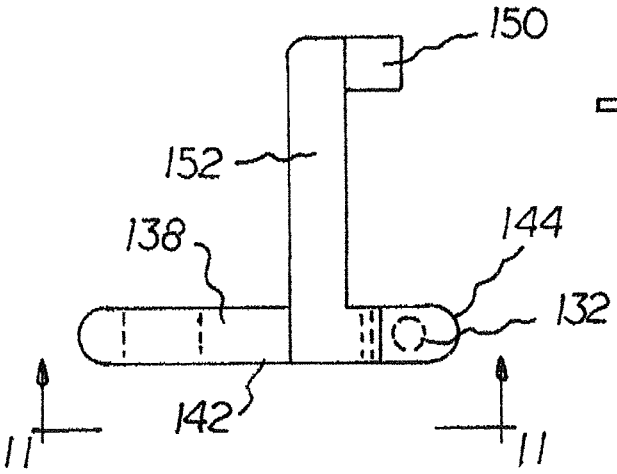
FIG. 10 is an enlarged showing of the shiftable component utilized in the FIG. 9 embodiment.
Figure 11:
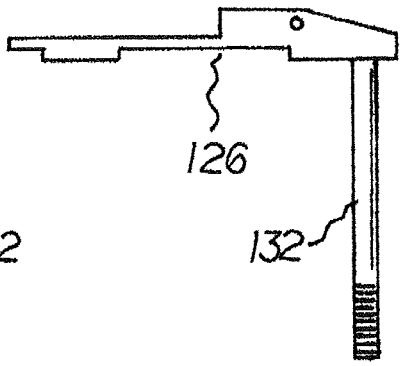
FIG. 11 is an enlarged showing of the bolt catch linkage of FIGS. 9 and 10.

Reference is now made to the alternate embodiment of FIGS. 9-11. This embodiment is with a bolt catch linkage devoid of a secondary button, but with a bolt catch linkage interchangeable with a bolt catch linkage of the primary embodiment having a secondary button. In this embodiment of the system 100, included is a bolt catch linkage 126 having a shiftable component 138 and a pivotable component 140. The shiftable component has a lower element 142 extending horizontally with a forward end 144 coupled to the shiftable pin 132. The shiftable component also has a rearward end and a central region between the forward end and the rearward end. The shiftable component also has an upper element 150 extending horizontally. The shiftable component also has a middle element 152 extending vertically between the upper element and the central region of the lower element. The pivotable component 140 has an L-shaped link adapted to move the output leg downwardly away from the bolt catch to engage the bolt catch.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bolt catch engagement/magazine releasing system comprising:

a firearm having a first side and a second side and a forward section with a barrel and a rearward section with a stock, the firearm having a bolt catch and a magazine, the firearm having a central section with an actuation button on the first side and bolt catch linkage on the second side and with a magazine release there between;

an actuation pin extending through the central section from the actuation button to both the bolt catch linkage and the magazine release, a coil spring urging the actuation button outwardly to an inoperative extended orientation, the actuation button adapted to be depressed for both releasing the magazine and engaging the bolt catch.

2. The system as set forth in claim 1 wherein the firearm is a rifle.

3. The system as set forth in claim 1 and further including a bolt catch linkage having a shiftable component and a pivotable component, the shiftable component having a lower element extending horizontally with a forward end coupled to the shiftable pin and a rearward end and a central region, the shiftable component also having an upper element extending horizontally, the shiftable component also having a middle element extending vertically between the upper element and the central region of the lower element, the pivotable component having an L-shaped link, the L-shaped link having an input leg and an output leg and a pivot pin there between, the input leg in response to pressing the actuation button adapted to be contacted by the upper element and move downwardly to thereby pivot the output leg downwardly away from the bolt catch to engage the bolt catch.

4. The system as set forth in claim 1 and further including a secondary button positioned on the left side of the firearm, the side opposite from the actuation button, the actuation button being more readily accessible to a right handed shooter, the secondary button being more accessible to a left handed shooter, the system thus being considered an ambidextrous system, a pivot pin operatively coupling the secondary button to the bottom of the middle element whereby pressing the secondary button pulls the actuation pin as if the actuation button were depressed.

5. The system (100) as set forth in claim 1 and further including:

a bolt catch linkage (126) having a shiftable component (138) and a pivotable component (140), the shiftable component having a lower element (142) extending horizontally with a forward end (144) coupled to the shiftable pin (132) and a rearward end and a central region there between, the shiftable component also having an upper element (150) extending horizontally, the shiftable component also having a middle element (152) extending vertically between the upper element and the central region of the lower element, the pivotable component (140) having an L-shaped link adapted to move the output leg downwardly away from the bolt catch to engage the bolt catch.

6. A rifle (10) with a bolt catch engagement/magazine releasing system (12), both releasing a magazine 14 and engaging a bolt catch (16) being done with a single movement, the system comprising, in combination:

a rifle having a forward section (18) with a barrel and a rearward section (20) with a stock, the rifle having a bolt catch and a magazine, the rifle having a central section (22) with an actuation button (25) on the right side and bolt catch linkage (26) on the left side and with a magazine release (28) there between;

an actuation pin (32) extending through the central section from the actuation button to both the bolt catch linkage and the magazine release, a spacer (24) and a coil spring (34) on the actuation pin urging the actuation button outwardly to an inoperative extended orientation, the actuation button adapted to be depressed for both releasing the magazine and engaging the bolt catch;

the bolt catch linkage (26) having a shiftable component (38) and a pivotable component (40), the shiftable component having a lower element (42) extending horizontally with a forward end (44) coupled to the shiftable pin and a rearward end (46) and a central region there between, the shiftable component also having an upper element (50) extending horizontally, the shiftable component also having a middle element (52) extending vertically between the upper element and the central region of the lower element, the pivotable component (40) having an L-shaped link (56), the L-shaped link having an input leg (58) and an output leg (60) and a pivot pin (62) there between, the input leg in response to pressing the actuation button adapted to be contacted by the upper element and move downwardly to thereby pivot the output leg downwardly away from the bolt catch to engage the bolt catch; and a secondary button (64) positioned on the left side of the firearm, the side opposite from the actuation button (25), the actuation button being more readily accessible to a right-handed shooter, the secondary button being more accessible to a left-handed shooter, the system thus being an ambidextrous system, a pivot pin (66) operatively coupling the secondary button to the bottom of the middle element (52) whereby pressing the secondary button pulls the actuation pin (32) as if the actuation button (25) were depressed.

* * * * *